US008104658B2

(12) United States Patent
Yu

(10) Patent No.: US 8,104,658 B2
(45) Date of Patent: Jan. 31, 2012

(54) BLOCK DEVICE FOR NAIL GUN

(75) Inventor: Chung Hung Yu, Taipei Hsien (TW)

(73) Assignee: De Poan Pneumatic Corp., Taichung (TW)

( * ) Notice: Subject to any disclaimer, the term of this patent is extended or adjusted under 35 U.S.C. 154(b) by 374 days.

(21) Appl. No.: 11/942,788

(22) Filed: Nov. 20, 2007

(65) Prior Publication Data

US 2009/0127310 A1 May 21, 2009

(51) Int. Cl.
*B25C 1/00* (2006.01)
*B27F 7/13* (2006.01)

(52) U.S. Cl. ..... 227/8; 227/120; 227/125

(58) Field of Classification Search ..... 227/8, 120, 227/125; 221/17
See application file for complete search history.

(56) References Cited

U.S. PATENT DOCUMENTS

| | | | | | |
|---|---|---|---|---|---|
| 3,606,128 | A * | 9/1971 | Cast et al. | 227/1 |
| 3,858,781 | A * | 1/1975 | Obergfell et al. | 227/8 |
| 4,197,974 | A * | 4/1980 | Morton et al. | 227/8 |
| 4,768,696 | A * | 9/1988 | Sjogren | 227/8 |
| 5,180,091 | A * | 1/1993 | Ota | 227/8 |
| 5,366,132 | A * | 11/1994 | Simonelli | 227/8 |
| 5,683,024 | A * | 11/1997 | Eminger et al. | 227/8 |
| 5,803,338 | A * | 9/1998 | Singer et al. | 227/8 |
| 5,816,468 | A * | 10/1998 | Yang | 227/8 |
| 6,012,622 | A * | 1/2000 | Weinger et al. | 227/8 |
| 6,189,759 | B1 * | 2/2001 | Canlas et al. | 227/120 |
| 6,199,739 | B1 * | 3/2001 | Mukoyama et al. | 227/8 |
| 6,209,770 | B1 * | 4/2001 | Perra | 227/8 |
| 7,028,875 | B1 * | 4/2006 | Beville et al. | 227/8 |
| 7,059,507 | B2 * | 6/2006 | Almeras et al. | 227/8 |
| 7,134,586 | B2 * | 11/2006 | McGee et al. | 227/125 |
| 7,303,103 | B2 * | 12/2007 | Wang | 227/8 |
| 2003/0121948 | A1 * | 7/2003 | Hsien | 227/120 |
| 2004/0222266 | A1 * | 11/2004 | Kakuda et al. | 227/8 |
| 2005/0218176 | A1 * | 10/2005 | Schell et al. | 227/8 |
| 2006/0180628 | A1 * | 8/2006 | Hung et al. | 227/8 |
| 2006/0213946 | A1 * | 9/2006 | Shkolnikov | 227/8 |
| 2007/0138229 | A1 * | 6/2007 | Fujimoto | 227/8 |
| 2008/0164295 | A1 * | 7/2008 | Wu et al. | 227/8 |
| 2009/0101688 | A1 * | 4/2009 | Ho | 227/8 |

FOREIGN PATENT DOCUMENTS

| | | |
|---|---|---|
| TW | M269156 | 7/2005 |

* cited by examiner

*Primary Examiner* — Lindsay Low
(74) *Attorney, Agent, or Firm* — Chun-Ming Shih

(57) ABSTRACT

A blocking device for a nail gun includes a push member disposed on a nail pusher in a nail cartridge of the nail gun for moving toward a nail groove base with the nail pusher, a brake member movably installed on the nail pusher for moving toward the nail groove base with the nail pusher, and a rotational fastener pivotably installed on the nail groove base on a moving path of the push member and the brake member. The fastener can be touched to rotate by the push member when there are a small number of remaining nails in the nail cartridge so as to prevent the brake member moving to a position where it blocks an upward movement of the safety bar, and can be released by the push member and rotate back to an original position when there is no remaining nail in the nail cartridge so as to release the brake member to move to a position where it blocks an upward movement of the safety bar and thereby a nail shooting action of the nail gun. The accuracy of the nail shooting blocking is improved.

6 Claims, 5 Drawing Sheets

BLOCK DEVICE FOR NAIL GUN

BACKGROUND OF THE INVENTION

1. Field of the Invention

The present invention relates to a blocking device for a nail gun for preventing a shooting action of the nail gun when there are no nails in the nail gun, and more particularly to a technology to detect whether there is any nail in the nail gun so as to hold or release a safety bar of the nail gun accordingly.

2. Description of Related Art

In most nail guns, there is generally a blocking device configured for automatically detecting for a "no nail" status when all nails, which are aligned in rows in a nail cartridge of the nail gun, are depleted during an operation of the nail gun and when such a status is detected disabling a trigger of the nail gun to drive a nail hitting bar to make a hitting movement so as to inform an operator to fill in nails to the nail gun.

A relatively advanced technology, as disclosed by Taiwan patent M269156, provides a blocking device for a nail gun for preventing a shooting action when the nail gun is in the "no nail" status as described above. A touch member is disposed on a nail pusher of the nail gun. An end groove opening outwards is formed on a side of a nail cartridge of the nail gun. A brake member is disposed in the end groove configured for receiving push from the touch member and rotating accordingly. A spring board configured for pushing the brake member is disposed on an outer wall of a side of the nail cartridge that has the brake member. By this means, when the last nail in the nail cartridge is pushed into a nail hitting groove and being shot, the touch member pushes the brake member to rotate slopingly out of the nail cartage so as to hold a safety bar of the nail gun, prevent the nail gun from continuing with a shooting action and inform an operator to fill in nails to the nail gun.

However, when the brake member rotates slopingly out of the nail cartridge as described above, the safety bar can only touch a sloping cross-section of the brake member, which may generate a sloping component force affecting the brake member. As a result, the braking member may be easily pushed by the safety bar back to a non working position, which hence reduces the accuracy and the reliability of the blocking device in preventing the nail gun from shooting in the "no nail" status. In addition, the spring board disposed on the outer wall of the nail cartridge is exposed outside and hence easy to be contaminated by outside dirt and dusts. The spring board being configured for pushing the brake member is only a thin slice so that the elastic force it can provide to bring the brake member back to an original position after the brake member rotates outwards may be limited and even insufficient. An elastic fatigue failure may happen to the spring board as well. Hence it is desired to provide a blocking device for a nail gun that overcomes the above-mentioned problems.

SUMMARY OF THE INVENTION

An object of the present invention is to provide a blocking device for a nail gun, the blocking device being installed on the nail gun, the nail gun having a nail groove base, a safety bar, and a nail cartridge. The blocking device includes:

a push member, disposed on a nail pusher in the nail cartridge and configured for moving toward the nail groove base along with the nail pusher;

a brake member, movably installed on the nail pusher by a spring, and configured for moving toward the nail groove base along with the nail pusher pushing the multiple nails in rows; and a rotational fastener, pivotably installed on the nail groove base by a spring on a moving path of the push member and the brake member, configured to be touched to rotate by the push member when there are a small number of remaining nails in the nail cartridge so as to prevent the brake member moving to a position where the brake member blocks an upward movement of the safety bar, and configured to be released by the push member and to rotate back to an original position when there are no remaining nails in the nail cartridge so as to release the brake member to move to a position where the brake member blocks an upward movement of the safety bar. The small number of remaining nails are fewer than ten nails. It is necessary for the safety bar to move upwards so as to initiate a nail shooting action.

In the preferred embodiments, after the last nail in the nail cartridge is shot, a side of the brake member can move into the safety bar's moving up path so as to block the safety bar, which improves the accuracy and the reliability of blocking the shooting action of the nail gun. In addition, by disposing all the components such as the push member, the brake member, the fastener, the first elastic member and so on all inside the nail gun the contamination from outside dirt and dusts can be avoided. Moreover, after stopping the safety bar, the brake member can return to an original nail-pushing position along with the nail pusher during refilling of nails so as to release the safety bar and disable the shooting-blocked status of the nail gun, which overcomes the problem in the related art that the brake member rotates outwards so that the restoring force is insufficient to disable the shooting-blocked status of the nail gun.

In further embodiments, the blocking device of the present invention includes the following. A containing groove is disposed on an end of the nail groove base connecting to the nail cartridge, the containing groove being configured for containing the push member when the push member moves into the containing groove. A guiding groove is disposed on an end of the nail pusher facing the nail groove base, the guiding groove being configured for slidably mounting the brake member thereon. A first elastic member is disposed between the guiding groove and the brake member, the first elastic member configured for providing a spring force. An end groove is formed on an end of the nail groove base connecting to the nail cartridge, the end groove being configured for engaging with the brake member and moving to a position to block the safety bar from moving up. A blocking part is formed on an end of the brake member, the blocking part being configured for moving to a position to block the safety bar from moving upwards, and a ladder-shaped surface is formed on the brake member, the ladder-shaped surface being configured to be stopped by the fastener. A pivot part is disposed on an end of the nail groove base connecting to the nail cartridge, and the fastener is pivotably disposed on the pivot part. A second elastic member is disposed between the fastener and the pivot part and configured for providing a spring force. The fastener includes a touch part configured to be touched by the push member and a fastening part configured to stop or release the brake member.

Other advantages and novel features will be drawn from the following detailed description of preferred embodiments with the attached drawings, in which:

DETAILED DESCRIPTION OF THE INVENTION

Figure 1:
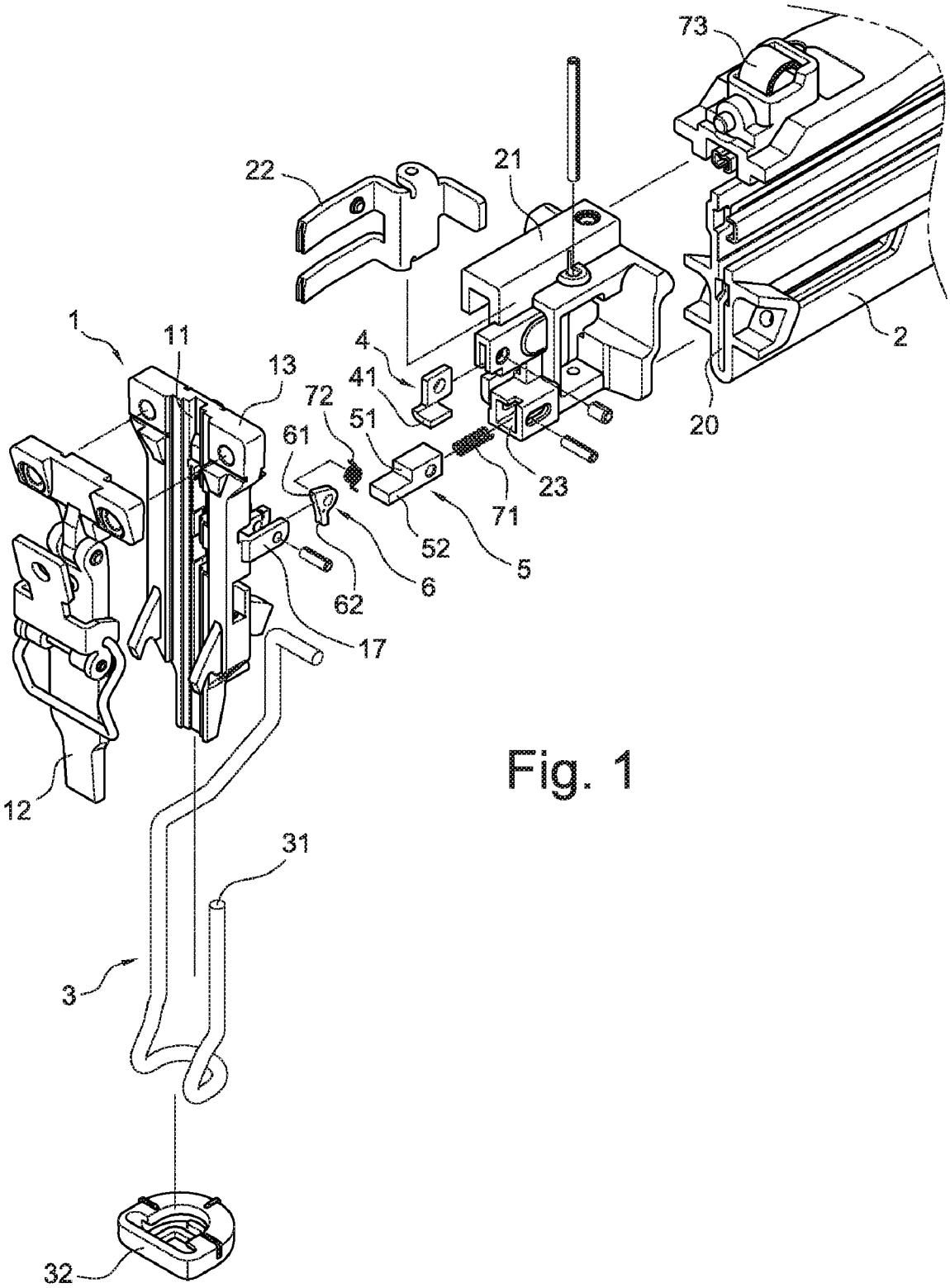
FIG. 1 is an exploded perspective view of a blocking device for a nail gun in accordance with a preferred embodiment of the present invention.
Figure 2:
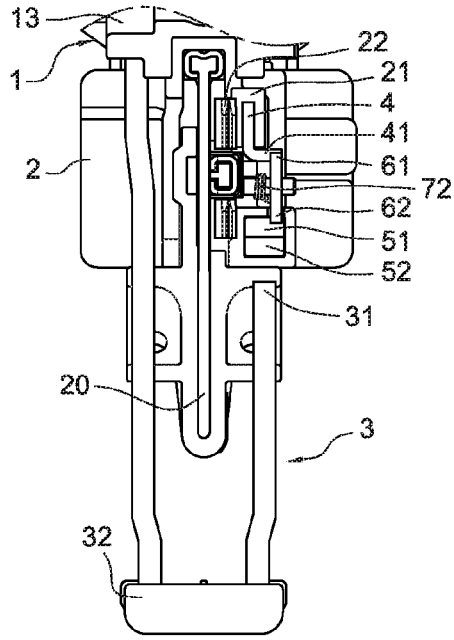
FIG. 2 is a side view of the blocking device for a nail gun in FIG. 1.
Figure 3:
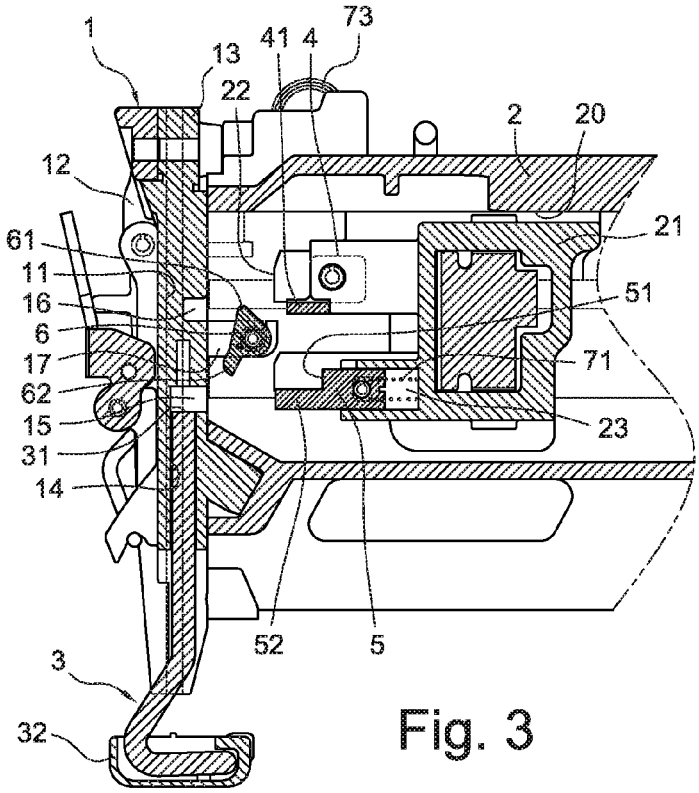
FIG. 3 is a side cross sectional view of the blocking device for a nail gun in FIG. 1.
Figure 8:
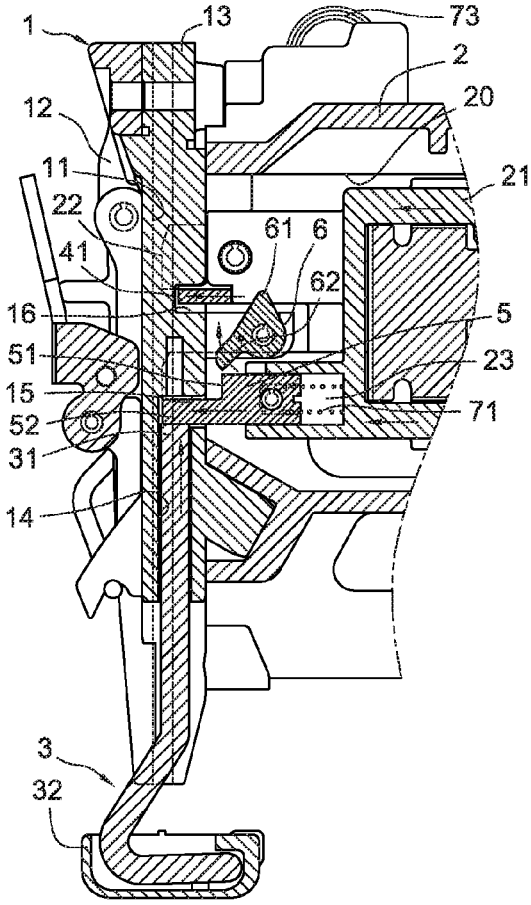
FIG. 8 is a side cross sectional view of FIG. 1 in yet another working status.

Referring to FIG. 1, FIG. 2 and FIG. 3, a blocking device for a nail gun in accordance with a preferred embodiment of the present invention is provided. The blocking device is installed on the nail gun, the nail gun having a nail groove base 1, a safety bar 3, and a nail cartridge 2. The blocking device includes:

a push member 4, disposed on a nail pusher 21 in the nail cartridge 2 and configured for moving toward the nail groove base 1 along with the nail pusher 21 pushing the multiple nails 8 in rows (as shown in FIG. 4 to FIG. 7);

a brake member 5, movably installed on the nail pusher 21 by a spring, and configured for moving toward the nail groove base 1 with the nail pusher 21 pushing the multiple nails 8 in rows; and a rotational fastener 6, pivotably installed on the nail groove base 1 by a spring on a moving path of the push member 4 and the brake member 5, configured to be touched to rotate by the push member 4 when there are a small number of remaining nails 8 in the nail cartridge 2 so as to prevent the brake member 5 moving to a position where the brake member 5 blocks an upward movement of the safety bar 3, and configured to be released by the push member 4 and to rotate back to an original position when there are no remaining nails in the nail cartridge 2 (as shown in FIG. 8) so as to release the brake member 5 to move to a position where the brake member 5 blocks an upward movement of the safety bar 3.

The small number of remaining nails 8 are fewer than ten nails. In this embodiment, the number of the remaining nails 8 in the nail cartridge is less than five.

The upward movement of the safety bar 3 refers to a necessary process of the safety bar 3 moving upwards to push an inner trigger of a trigger of the nail gun to rotate when an operator pulls the trigger, so as to open a trigger valve of the nail gun and initiate a nail shooting action.

In a further embodiment, the safety bar 3 is slidably disposed between a upper guiding board 12 and a lower guiding board 13 of the nail groove base 1 (as shown in FIG. 1 and FIG. 3). A nail hitting groove 11 and a guiding groove 14 parallel to the nail hitting groove 11 are respectively formed between the upper guiding board 12 and the lower guiding board 13. At a side of the safety bar 3, a push part 31 is slidably disposed in the guiding groove 14 and near to an end of the nail hitting groove 11. The other side of the safety bar 3 extends to a position where the safety bar 3 can push a spring in the trigger and drive the trigger valve to initiate a nail shooting action. The part of the safety bar 3 between the two ends thereof extends out of the nail hitting groove 11 and connects to a hitting base 32 for pushing a workpiece.

The nail cartridge 2 is connected to an opening of the nail hitting groove 11 of the nail groove base 1. A nail groove 20 is formed in the nail cartridge 20, the nail groove 20 being connected to the nail hitting groove 11 and configured for containing multiple nails 8 in rows (as shown in FIG. 1 to FIG. 3). The nail pusher 21 is slidably disposed in the nail groove 20. A third elastic member 73 is disposed between the nail groove 20 and outer walls of the nail cartridge 2 and configured for driving the nail pusher 21 to move toward the nail hitting groove 11. In this embodiment, the third elastic member 73 is a curve-shaped spring or equivalent thereto. A push paw 22 is disposed on a side of the nail pusher 21 facing the nail hitting groove 11, and configured for pushing the multiple nails 8 in rows to enter the nail hitting groove 11 one after another.

Figure 5:
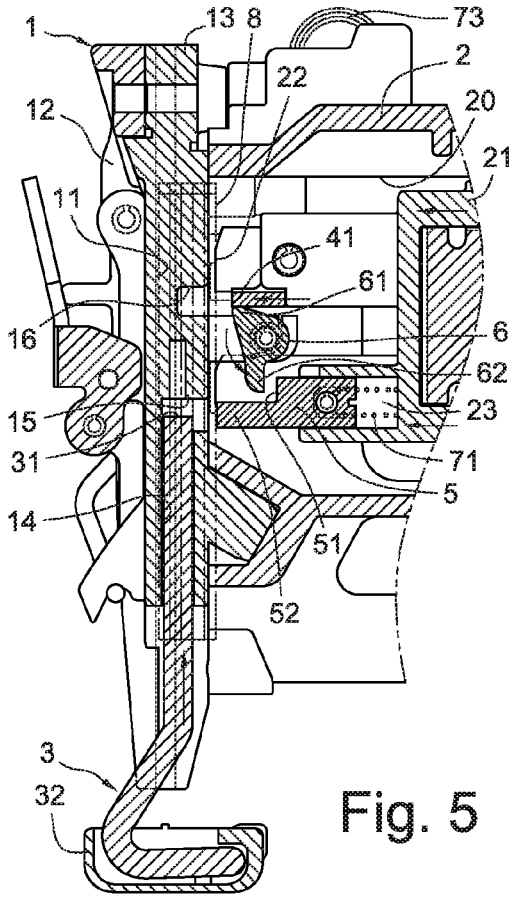
FIG. 5 is a side cross sectional view of FIG. 1 in another working status.
Figure 6:
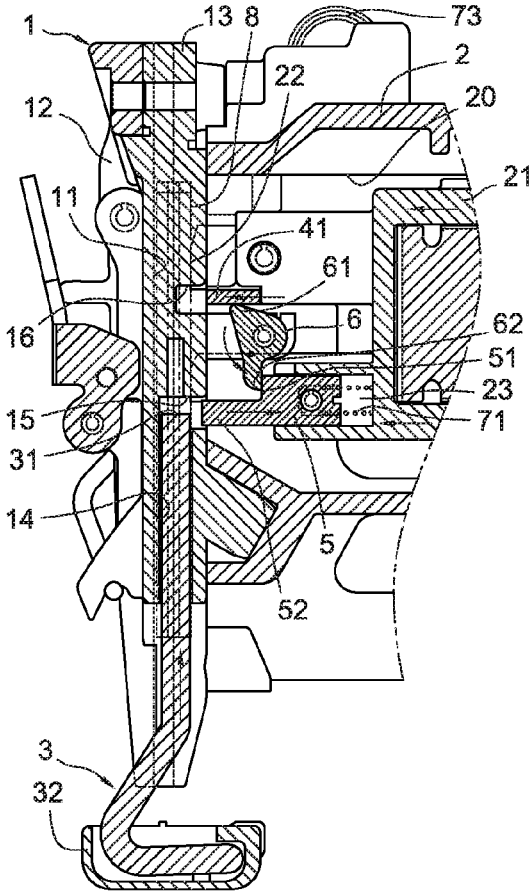
FIG. 6 is a side cross sectional view of FIG. 1 in yet another working status.
Figure 7:
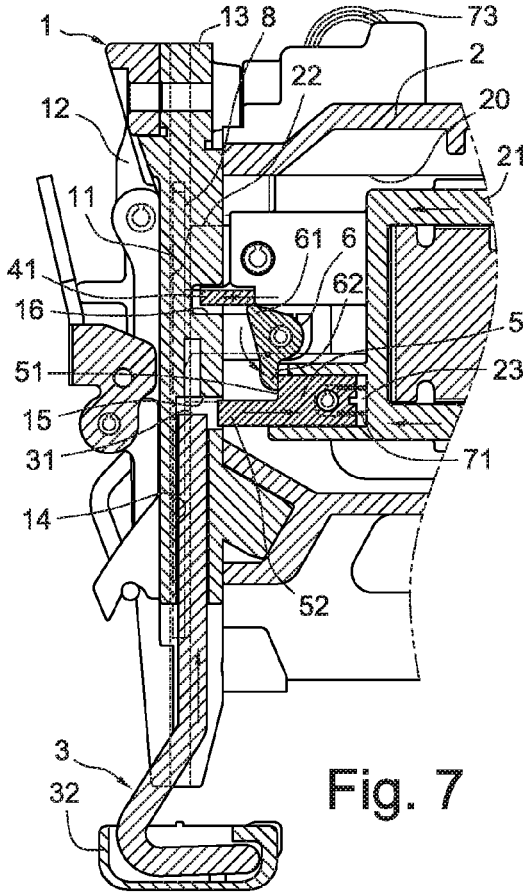
FIG. 7 is a side cross sectional view of FIG. 1 in yet another working status.

The push member 4 has an ear board 41 corresponding to the fastener 6 (as shown in FIG. 1 and FIG. 3). The ear board 41 is configured for pushing the fastener 6 when there are a small number of remaining nails 8 in the nail cartridge 2 and the nail hitting groove 11 (as shown in FIG. 5 to FIG. 7).

Referring to FIG. 3 to FIG. 9, a containing groove 16 and an end groove 15 are respectively disposed on an end of the nail groove base 1 connecting to the nail cartridge 2. The containing groove 16 is configured for containing the ear board 41 of the push member 4. The brake member 5 can engage with the end groove 15 and move to a position to block the safety bar 3 from moving up.

Referring to FIG. 1 and FIG. 3, a guiding groove 23 is disposed on an end of the nail pusher 21 facing the nail hitting groove 11 of the nail groove base 1. The brake member 5 is slidably disposed in the guiding groove 23. A first elastic member 71 is disposed in between the guiding groove 23 and the brake member 5 for providing a spring force to push the brake member to move out of the guiding groove 23. In this embodiment, the first elastic member 71 is a spiral spring or equivalent thereto.

Referring to FIG. 1 to FIG. 3, a blocking part 52 is formed on an end of the brake member 5 and configured for moving into the end groove 15 and blocking the push part 31 of the safety bar 3 from moving upwards. Referring to FIG. 6 and FIG. 7, a ladder-shaped surface 51 is formed on the brake member 5 and configured to be pushed by the fastener 6 and thereby drive the brake member 5 to get back to the guiding groove 23.

Referring to FIG. 1 and FIG. 3, a pivot part 17 is disposed on an end of the nail groove base 1 connecting to the nail cartridge 2. The fastener 6 is pivotably disposed on the pivot part 17. Referring to FIG. 2, a second elastic member 72 is disposed between the fastener 6 and the pivot part 17 for providing a spring force. In this embodiment, the second elastic member 72 is a torque spring or equivalent thereto. In addition, the fastener 6 has a touch part 61 touchable by the ear board 41 of the push member 4 and a fastening part 62 for stopping or releasing the ladder-shaped surface 51 of the brake member 5.

The blocking device for a nail gun provided by the preferred embodiments as described above operate as follows.

Figure 4:
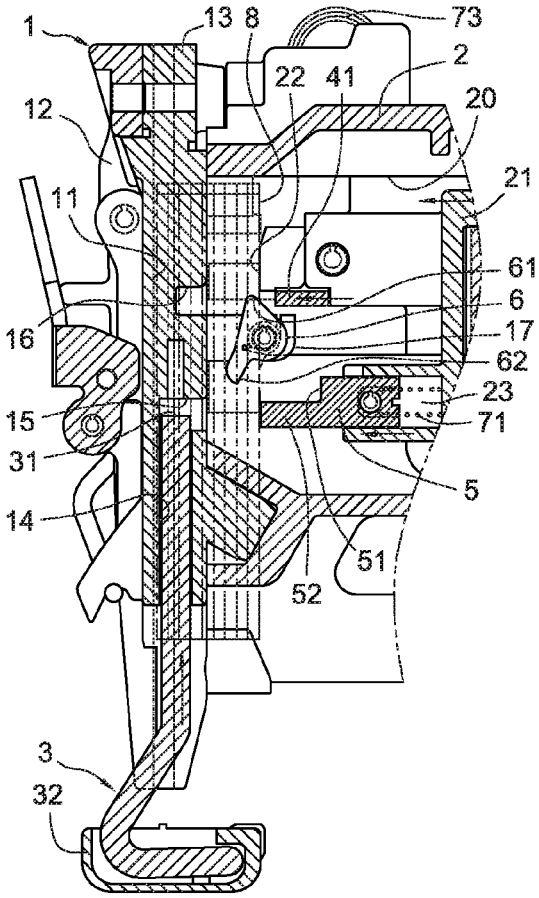
FIG. 4 is a side cross sectional view of FIG. 1 in a working status.

Referring to FIG. 4, when there are multiple nails 8 in rows in the nail hitting groove 11 and the nail groove 20 of the nail cartridge 2, the push member 4 can not push the fastener 6 to rotate, and the brake member 5 can not move into the end groove 15. In this case, an operator of the nail gun can smoothly tap or push the hitting base 32 of the safety bar 3 upon a workpiece so that the push part 31 can move up along the guiding groove 14 to further move the safety bar 3 upwards, which moves the inner trigger up and open the trigger valve to initiate a shooting action.

Referring to FIG. 5, when there are only five remaining nails 8 in the nail hitting groove 11 and the nail groove 20 of the nail cartridge 2, although the ear board 41 of the push member 4 can touch the touch part 61 of the fastener 6 to rotate, the brake member 5 can not move to a position where the brake member can be stopped by the fastening part 62 of the fastener 6 and the brake member 5 can not move into the end groove 15. In this case, the operator can still smoothly tap or push the safety bar 3 to move upwards and thereby open the trigger valve to initiate a shooting action.

Referring to FIG. 6 and FIG. 7, when there are only three or less remaining nails 8 in the nail hitting groove 11 and the nail groove 20 of the nail cartridge 2, the ear board 41 of the push member 4 can touch the touch part 61 of the fastener 6 and cause the fastening part 62 of the fastener 6 to rotate to a position where it can stop the ladder-shaped surface 51 of the brake member 5 so as to stop the ladder-shaped surface 51 and move the brake member 5 back into the guiding groove 23. As a result, the blocking part 52 of the brake member 5 can not be driven by the nail pusher 21 to move into the end groove 15. In this case, the operator can still smoothly tap or push the safety bar 3 to move upwards and thereby open the trigger valve to initiate a shooting action.

Referring to FIG. 7 and FIG. 8, when the last nail 8 in the nail hitting groove 11 and the nail groove 20 is being shot, all the nails 8 in the nail cartridge 2 and the nail hitting groove 11 are depleted, the push paw 22 of the nail pusher 21 is released by the last nail 8 so that the nail pusher 21 drives the push member 4 and the brake member 5 to move together toward the nail hitting groove 11. The touch part 61 of the fastener 6 is thus disengaged from the pushing by the ear board 41 of the push member 4 and the fastener 6 rotates to reset so that the fastening part 62 releases the ladder-shaped surface 51 of the brake member 5, which makes the brake member 5 to be driven by the first elastic member 71 and move out of the guiding groove 23 and nail pusher 21 drives the blocking part 52 of the brake member 5 to move into the end groove 15 and the guiding groove 14. In this case, if the operator taps or pushes the hitting base 32 of the safety bar 3 onto a workpiece, the push part 31 moving up along the guiding groove 14 is blocked by the blocking part 52 between the end groove 15 and the guiding groove 14 so that the safety bar 3 can not move up and initiate a shooting action.

Figure 9:
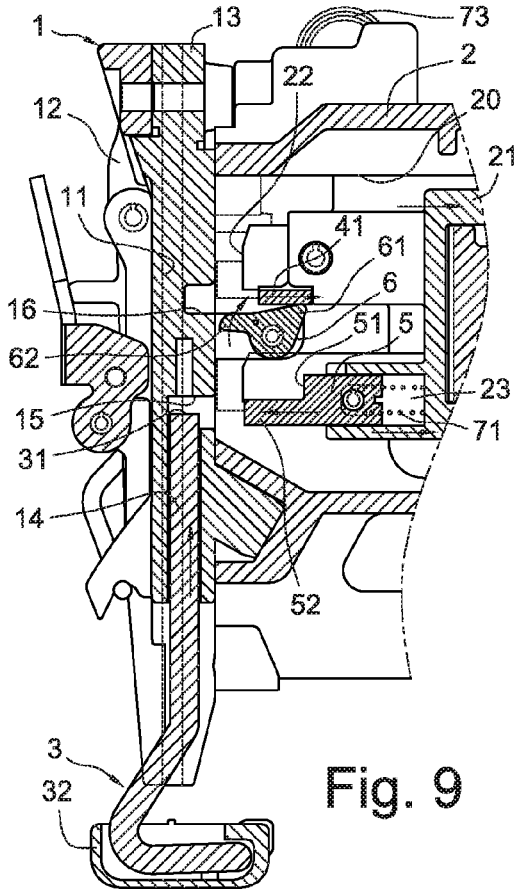
FIG. 9 is a side cross sectional view of FIG. 1 in yet another working status.

Referring to FIG. 9, when the operator intends to refill multiple nails 8 and moves the nail pusher back to a bottom of the nail groove 20 of the nail cartridge 2, the push member 4 moves with the nail pusher 21 to reset so that the touch part 61 of the fastener 6 is reversely touched by the ear board 41 of the push member 4. As a result, the fastener 6 rotates reversely and releases the ear board 41 so that the ear board 41 moves toward the bottom of the nail groove 20 to reset and the brake member 5 moves along the nail pusher 21 to reset. The blocking part 52 of the brake member 5 is disengaged from the end groove 15 so as to release the safety bar 3 so that the safety bar 3 can move up and the nail gun can resume shooting nails after being refilled with multiple nails 8.

In above mentioned embodiments, after the last nail 8 in the nail cartridge 2 is shot, the blocking part 52 on a side of the brake member 5 can move into the path of the push part 31 of the safety bar 3's moving up through release of a spring force so as to block the safety bar 3, which improves the accuracy of blocking the shooting action of the nail gun. In addition, by disposing the push member 4, the brake member 5, the fastener 6, the first elastic member 71 and etc. all inside a closed body of the nail gun the contamination from outside dirt and dusts can be avoided, which makes the blocking device for the nail gun suitable for practical use.

While the present invention has been illustrated by the description of preferred embodiments thereof, and while the preferred embodiments have been described in considerable detail, it is not intended to restrict or in any way limit the scope of the appended claims to such details. Additional advantages and modifications within the spirit and scope of the present invention will readily appear to those skilled in the art. Therefore, the present invention is not limited to the specific details and illustrative examples shown and described.

What is claimed is:

1. A blocking device for a nail gun, the blocking device being installed on the nail gun, the nail gun having a nail groove base, a safety bar, and a nail cartridge, the blocking device comprising:

a push member, disposed on a nail pusher in the nail cartridge and configured for moving toward the nail groove base along with the nail pusher pushing multiple nails;

a brake member, movably installed on the nail pusher by a first spring force, and configured for moving toward the nail groove base with the nail pusher pushing the multiple nails; and a rotational fastener, pivotably installed on the nail groove base by a second spring force on moving paths of the push member and the brake member, having a touch part configured to be touched to rotate by the push member and a fastening part configured to have physical contact with the brake member to stop the brake member when there are a small number of remaining nails in the nail cartridge so as to prevent the brake member moving to a position where the brake member blocks an upward movement of the safety bar, and configured to be released by the push member and to rotate back to an original position when there is no remaining nail in the nail cartridge so as to release the brake member to move to the position where the brake member is engaged to an end groove formed on the nail groove base and have physical contact with the safety bar to block the upward movement of the safety bar, the small number of remaining nails being less than ten nails, wherein a guiding groove is disposed on an end of the nail pusher facing the nail groove base, the guiding groove being configured for slidably mounting the brake member thereon, and wherein a first elastic member is disposed between the guiding groove and the brake member, the first elastic member being configured for providing the first spring force.

2. The blocking device for a nail gun as described in claim 1, wherein a containing groove is disposed on an end of the nail groove base connecting to the nail cartridge, the containing groove being configured for containing the push member when the push member moves into the containing groove while there is no remaining nail in the nail cartridge.

3. The blocking device for a nail gun as described in claim 1, wherein the push member comprises an ear board, the ear board being configured for touching the fastener when there are the small number of remaining nails in the nail cartridge.

4. The blocking device for a nail gun as described in claim 1, wherein a blocking part is formed on an end of the brake member, the blocking part being configured for moving to the position to block the safety bar from moving upwards, and a ladder-shaped surface is formed on the brake member, the ladder-shaped surface being configured to be stopped by the fastener.

5. The blocking device for a nail gun as described in claim 1, wherein a pivot part is disposed on an end of the nail groove base connecting to the nail cartridge, and the fastener is pivotably disposed on the pivot part.

6. The blocking device for a nail gun as described in claim 1, wherein a second elastic member is disposed between the fastener and a pivot part which is disposed on an end of the nail groove base and configured for providing the second spring force.

* * * * *